US006341722B1

(12) United States Patent
Tolve et al.

(10) Patent No.: US 6,341,722 B1
(45) Date of Patent: Jan. 29, 2002

(54) FEEDER OF MOLTEN METAL FOR MOULDS OF CONTINUOUS CASTING MACHINES

(75) Inventors: Pietro Tolve, Rome; Franco Macci, Latina; Romeo Capotosti, Narni, all of (IT)

(73) Assignees: Acciai Speciali Terni S.p.A., Terni (IT); Voest-Alpine Industrieanlagenbau GmbH, Linz (AU)

( * ) Notice: Subject to any disclaimer, the term of this patent is extended or adjusted under 35 U.S.C. 154(b) by 0 days.

(21) Appl. No.: 09/367,281

(22) PCT Filed: Feb. 13, 1998

(86) PCT No.: PCT/IT98/00025

§ 371 Date: Oct. 26, 1999

§ 102(e) Date: Oct. 26, 1999

(87) PCT Pub. No.: WO98/35774

PCT Pub. Date: Aug. 20, 1998

(30) Foreign Application Priority Data

Feb. 14, 1997 (IT) ..... RM97A0081

(51) Int. Cl.[7] ..... B22D 35/00
(52) U.S. Cl. ..... 222/606; 222/594
(58) Field of Search ..... 222/590, 591, 222/594, 606, 607

(56) References Cited

U.S. PATENT DOCUMENTS 5,603,860 A * 2/1997 Hohenbichler ..... 222/607
5,775,552 A * 7/1998 Pleschiutschnigg ..... 222/607
5,785,880 A * 7/1998 Heaslip et al. ..... 222/594
5,811,023 A * 9/1998 Hohenbichler ..... 222/606

FOREIGN PATENT DOCUMENTS

| | | |
|---|---|---|
| DE | 38 32 003 | 4/1989 |
| NL | 88 01 101 | 11/1989 |

OTHER PUBLICATIONS

Patent abstracts of Japan, 03–027,847, Feb. 6, 1991.

Patent abstracts of Japan, 63–183,752, Jul. 29, 1988.

Patent abstracts of Japan, 04–344,857, Dec. 1, 1992.

Derwent patent abstract, 89–362148m Nov. 16, 1989, Section Ch, Week 8949, Derwent publications ltd., London, Great Britain.

* cited by examiner

*Primary Examiner*—Scott Kastler
(74) *Attorney, Agent, or Firm*—Browdy and Neimark

(57) ABSTRACT

The present invention provides a feeder of molten metal for moulds of continuous casting machines comprising a cylindrical body (1) within which a main outflow duct (5) of the molten metal coming from the tundish is formed to which the cylindrical body (1) is connected by means of a frustoconical joint (2), formed integrally with the cylindrical body (1) at the upper end thereof, characterized in that the free end (3) of the cylindrical body (1) is of substantially frustopyramid shape and has a plurality of outlets (7, 8, 9, 10, 11) communicating with the main outflow duct (5).

13 Claims, 3 Drawing Sheets

FEEDER OF MOLTEN METAL FOR MOULDS OF CONTINUOUS CASTING MACHINES

CROSS REFERENCE TO RELATED APPLICATION the present application is the national stage under 35 U.S.C. 371 of PCT/IT98/00025, filed Feb. 13, 1998.

The present invention relates to a feeder of molten metal for moulds of continuous casting machines of products of small thickness, and more precisely, to a feeder of molten metal for moulds in continuous casting machines which is apt to feed the molten metal in the mould in a uniform manner and transversally to the mould itself.

Continuous casting machines of molten metal are known which comprise a mould delimited by a pair of cylindrical counter-rotating rollers with horizontal axes and lying or not on a same horizontal plane, and by two side containment end members contacting the end portions of said rollers.

Said rollers are generally metallic and cooled inside through circulation of a refrigerant liquid under pressure (water for example) and spaced in order to allow continuous casting from the mould of a solidified body which has a thickness and a width approx. equal to the length of the rollers where the solidification takes place.

Furthermore, the so-described mould is provided to be fed by a feeder of molten metal connected to a tundish above the mould.

Great effort has been made up to now by the greatest steel manufacturers and installers to solve the several problems connected with the continuous casting of thin thicknesses of alloy steel, in particular stainless and magnetic, the quality thereof depends, among other things, on the superficial perfectness of the cast body.

In fact, among the most important causes of surface defectiveness in a continuously cast product is the lack of uniformity in the distribution of the molten metal in the mould. Said lack of uniformity causes differences in the temperature and material flow which, in turn, influence the cooling speed and the thickness of the cast product as well as its structure and superficial homogeinity.

In particular, changes in the material flow and temperature lead to the following problems:

a) superficial waving, which determines a non-horizontal curve of the points where the solidification starts with subsequent lack of uniformity in temperatures of the casting product which encourages the increase in the superficial defectiveness, i.e. the increase in the density of cracks and superficial roughness;

b) non-homogeneous distribution of the temperature in the mould, which causes longitudinal oscillations in thickness, also called depressions.

The above-mentioned problems are much more felt in case of continuous casting of thin products. In fact, given the small dimensions of moulds, it is difficult to control the flow and the related turbolences as well as the temperature distribution.

Different methods and devices have been devised for this purpose. In NL-A-8801101 a frustum of pyramid is applied on the bottom of an immersion pipe, but the walls of the pipe do not diverge from each other downwards in the lower portion thereof. In JP-A-03027847 is disclosed a submerged nozzle wherein the walls of the lower portion converge toward each other downwards.

The EP patent 515 075 illustrates a method and an apparatus of continuous casting of thin metal products.

According to the above mentioned patent, the apparatus includes a feeder of molten metal to the mould comprising an inlet duct for the molten metal extending to an outlet opening of the molten metal. The feeder is characterized in that said duct has a curved side surface apt to eliminate possible turbolences and discontinuities of the molten metal flow in the mould therebelow.

Said solution appears on one side excessively complex from a mechanical point of view, in view of the need of having a tundish integrally connected to a weir and to a cleft plunger. On the other side, it does not show good functional requirements, such as the semplicity in the construction of the feeder, the great reliability, the easy handling, the ease in the pre-heating of the feeder both when mounted and out of line and the possibility of moving it, while hot, for operation.

The present invention overcomes all the above-mentioned disadvantages. It is in fact object of the present invention to provide a feeder of molten metal for moulds of continuous casting machines comprising a cylindrical body, within which a main outflow duct of the molten metal coming from the tundish is formed to which the cylindrical body is connected by means of a frustoconical joint, formed integrally with the cylindrical body at the upper end thereof, characterized in that the free end of the cylindrical body is frustopyramid in shape with at least two sloping walls diverging from each other downwards and has a plurality of outlets communicating with the main outflow duct.

Further, according to the present invention, each sloping wall forms an angle with the longitudinal axis of the feeder comprised between 10° and 45°.

Furthermore, according to the present invention, at least two outlets of said plurality of outlets have their longitudinal axis forming an angle with the longitudinal axis of the feeder comprised between 0° and 95° and, preferably, between 65° and 95°.

Furthermore, according to the present invention, the base of the frustopyramid-shaped free end of the feeder can be plane or convex.

Furthermore, according to the present invention, at least a portion of the longitudinal axes of said plurality of outlets and the longitudinal axis of the feeder lie on the same plane.

In case, according to the present invention, at least two outlets of said plurality of outlets have their longitudinal axes forming an angle with the longitudinal axis of the feeder comprised between 0° and 90° and each of said longitudinal axes lies on a plane orthogonal with the plane containing the longitudinal axes of the remaining outlets and of said feeder.

Furthermore, according to the present invention, the feeder has optionally the base of its free end having at least one cleft shaped outlet.

Furthermore, according to the present invention, the feeder is characterized in that it is made of refractory material chosen among the group comprising: silicon dioxide, graphite alumina and zirconium-coated graphite alumina.

The present invention also refers to the use of the feeder according to claims 11 and 13.

The present invention will be illustrated in greater detail in the following by a description of various preferred embodiments thereof, given as a non-limiting example and with reference to the enclosed drawings.

Figure 1:
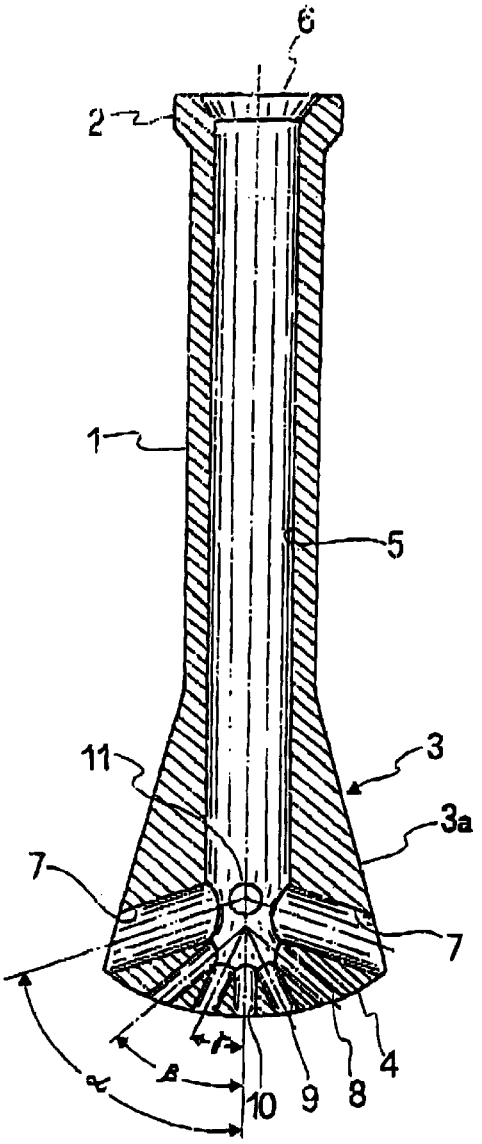
FIG. 1 is a longitudinal cross section view of a first embodiment of the feeder, according to the present invention.

With reference now to FIG. 1, a longitudinal cross section view of the feeder of the present invention according to a first embodiment is shown.

The feeder has a cylindrical body 1 and on the upper end thereof a single piece frustoconical joint 2 is formed for the connection to a tundish thereabove (not shown in the figure). The free end of the feeder has a portion 3, of frustopyramid in shape, integral with the cylindrical body 1 and a convex shaped base 4.

The frustopyramid portion 3 has two sloping walls 3*a* and two substantially vertical walls 3*b* (not shown in the figure and illustrated in detail hereinafter).

A main outflow duct 5 for the molten metal is formed inside the cylindrical body 1. The main duct 5 communicates upwards with the outside through an opening 6, and downwards with a plurality of outlets (later described in more detail) which communicate towards the outside.

Said plurality of outlets is constituted by a pair of openings 7 symmetrically arranged and having their longitudinal axes forming an angle $\alpha$ with the longitudinal axis of the feeder.

Below each opening 7, two openings 8 and 9 respectively are formed, having a diameter smaller than the openings 7. The openings 8 and 9 have their longitudinal axes forming an angle $\beta$ and $\gamma$, respectively, with the longitudinal axis of the feeder. Furthermore, an additional opening 10 is formed at the center of the base 4, having the same diameter compared to the openings 8 and 9, and vertically arranged.

Furthermore, at the portion where two openings 7 are formed, two additional openings 11 (only one of which being shown in the figure), and having a diameter substantially equivalent to the openings 8, 9 and 10 are further formed, said openings 11 facing on the walls 3*b* of the free end 3 and, therefore, orthogonally to the walls 3*a*. In the same manner as the openings 7, also the openings 11 form an angle $\alpha$ with the longitudinal axis of the feeder.

Figure 2:
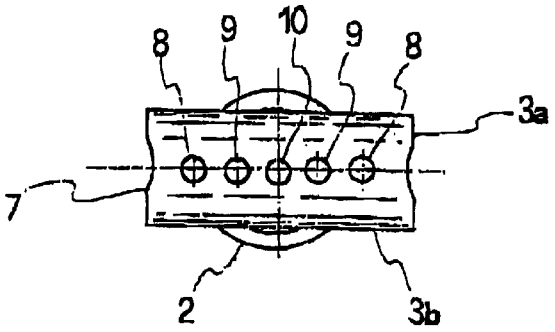
FIG. 2 is a bottom plan view of the feeder of FIG. 1.

With reference now to FIG. 2, a bottom plan view of the feeder of FIG. 1 is shown.

As it can be better noted, the axes of the openings 7, 8, 9 and 10 lie all on the same plane which contains also the longitudinal axis of the feeder.

Figure 3:
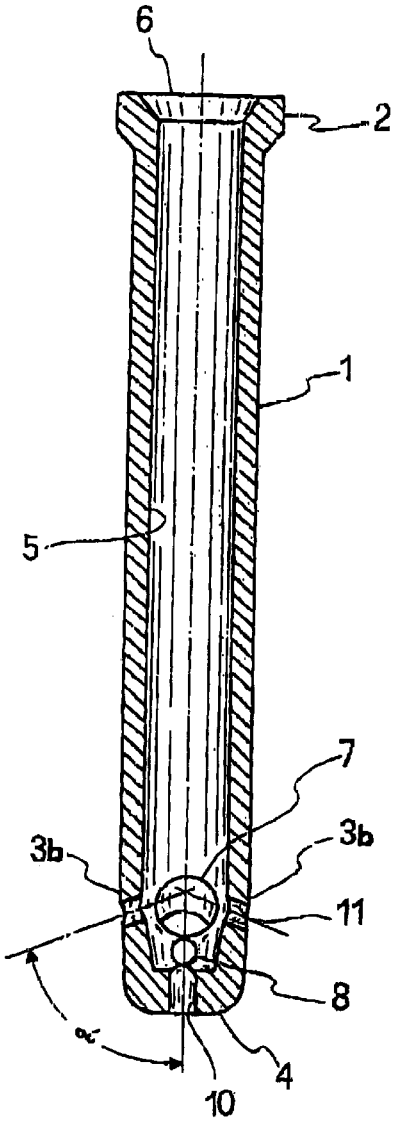
FIG. 3 is a side and longitudinal cross section view of the feeder of FIG. 1.

With reference to FIG. 3, a longitudinal cross section view and a side view of the feeder of FIG. 1 are shown.

As it can be better noted, the openings 11 are formed on the walls 3*b* and have their longitudinal axes forming an angle $\alpha$ with the longitudinal axis of the feeeder and their diameter is substantially equal to the diameter of the openings 8, 9 and 10.

Figure 4:
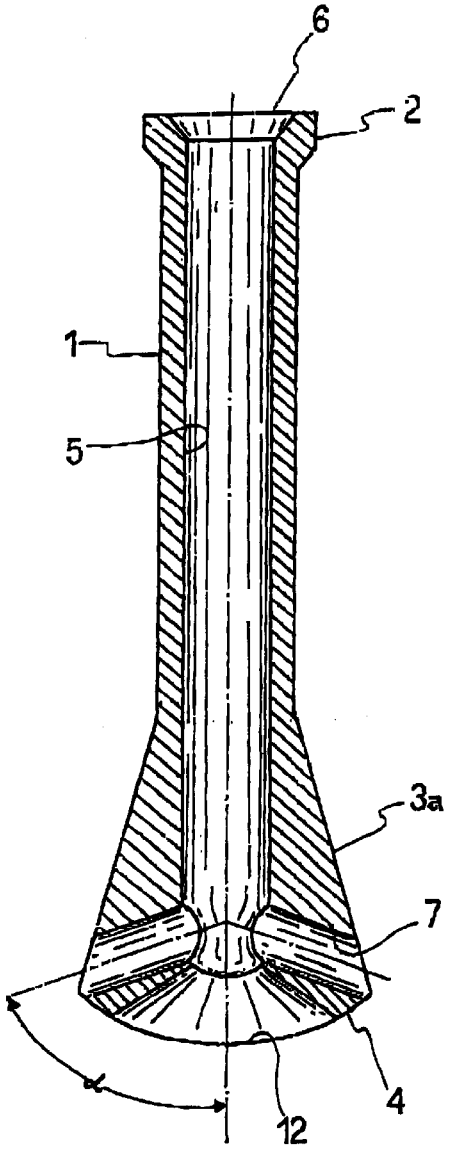
FIG. 4 is a longitudinal cross section view of a second embodiment of the feeder according to the present invention.
Figure 5:
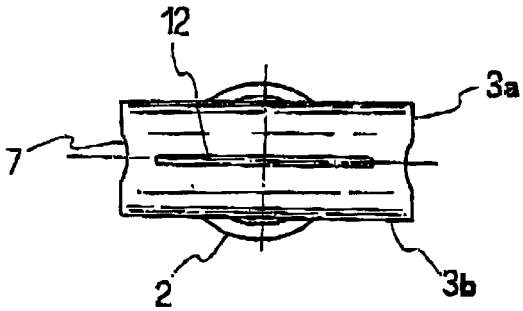
FIG. 5 is a bottom plan view of the feeder of FIG. 4.

With reference now to FIGS. 4 and 5, a longitudinal cross section view and a bottom plan view, respectively, of a second embodiment of the feeder of the present invention are shown.

For the sake of semplicity, same portions have the same numbers and, therefore, their description is omitted as already previously described.

As it can be better noted in the figures, the base 4 shows one single outlet 12 which is cleft in shape. Similarly to the previous embodiment, the opening 12 lies on the same plane of the axes of the openings 7 and the longitudinal axis of the feeder. Furthermore, the openings 7 form an angle $\alpha$ with the longitudinal axis of the feeder.

Figure 6:
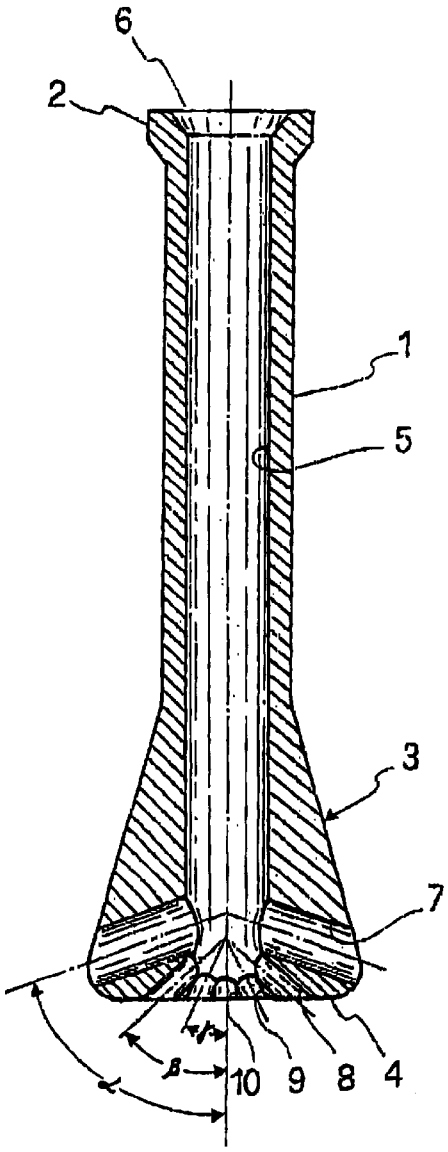
FIG. 6 is a longitudinal cross section view of a third embodiment of the feeder according to the present invention.
Figure 7:
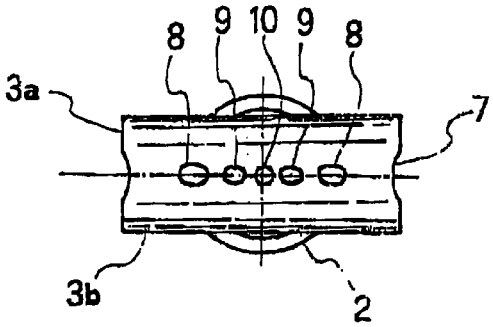
FIG. 7 is a bottom plan view of the feeder of FIG. 6.

With reference now to FIGS. 6 and 7, a longitudinal cross section view and a bottom plan view, respectively, of a third embodiment of the feeder of the present invention are shown.

For the sake of semplicity, same portions have the same numbers and, therefore, their description is omitted as already previously described.

As it can be better noted in the figures, the base 4 of the free end 3 of the feeder,is flat in shape and has pairs of openings 7, 8 and 9 which have their longitudinal axes forming angles $\alpha$, $\beta$, $\gamma$, respectively, with the longitudinal axis of the feeder. Furthermore, an additional opening 10 is formed at the center of the base 4 vertically arranged, having the same diameter compared to the diameter of the openings 8 and 9.

It is necessary to precise that, as it can be noted from the preceding figures, the cross section shape of the openings can be circular, elliptical, rectangular, square or polygonal or another else. The arrangement of the openings is however symmetric compared to the longitudinal axis of the feeder. The direction of the longitudinal axes of each pair of openings 7 can be horizontal, sloping downwardly or upwardly.

The number of openings for each wall of the free end, i.e. the walls 3*a* and 3*b*, can be single or can be also multiple (two, three, four, etc.). Openings 11 with dimensions smaller or equal than the side openings 7 can be provided at the two side walls 3*b*. In this way, the metal flow is facilitated.

Furthermore, the lower openings 8, 9 and 10 can be different in shape and number.

The lower portion of the feeder can be curved or flat. The adoption of one or the other solution is related on one side to the necessary guarantees of strength which the manufacture shall have and on the other side to the suitable length of the ducts in order to guide the flow.

Figure 8:
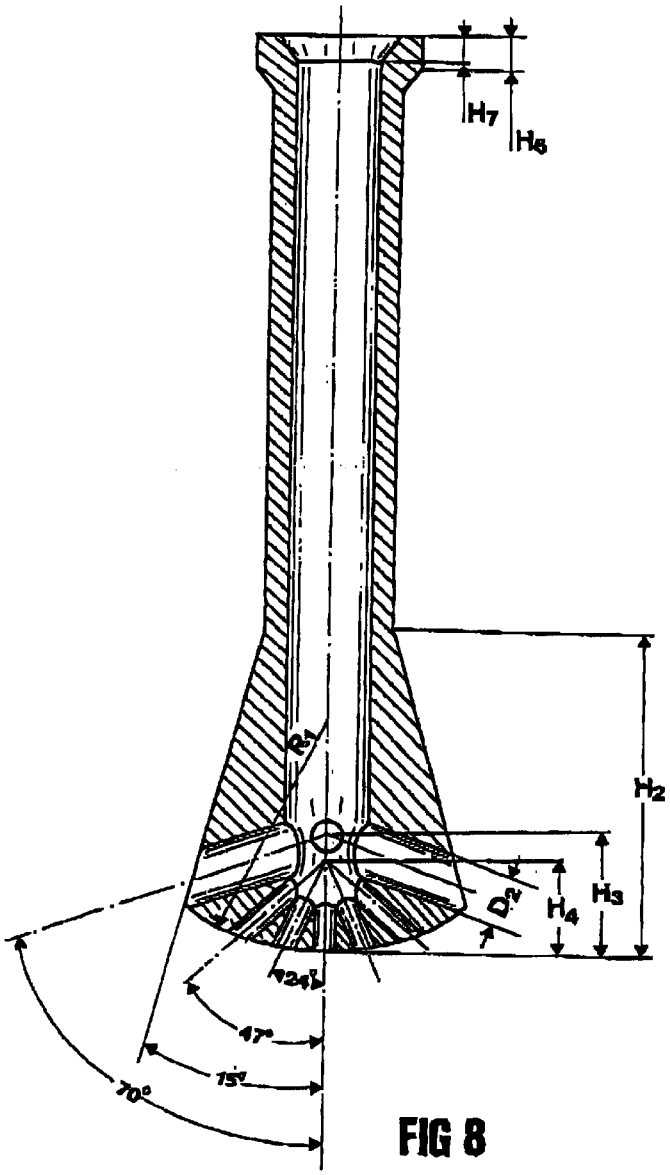
FIGS. 8, 9 and 10 are longitudinal cross section views, bottom plan views and longitudinal side views, respectively, of a fourth embodiment of the feeder according to the present invention.
Figure 10:
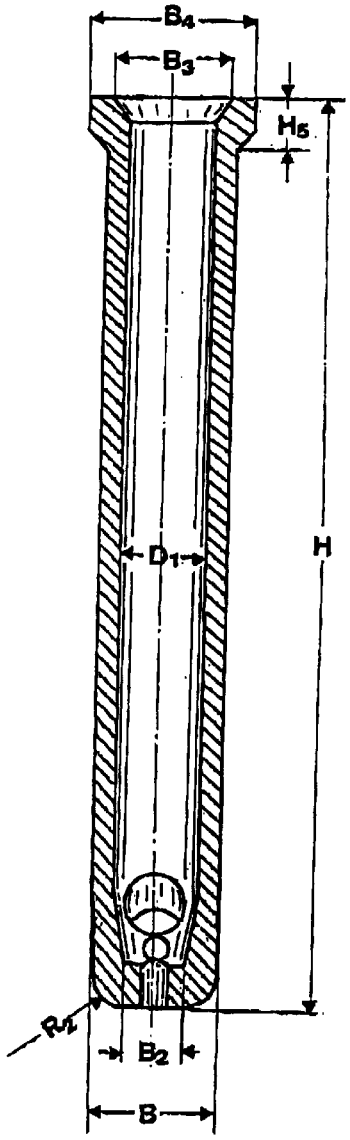
Figure 9:
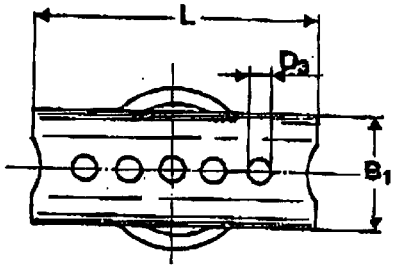

With reference now to FIGS. 8, 9 and 10 a fourth embodiment of the feeder according to the present invention is shown.

Said fourth embodiment corresponds to an optimum sizing of the feeder.

For the sizing of the cross-sections and the lengths of the feeder, calculations have been made using numeric simulations with a commercial thermofluidmechanical calculation code (PHOENICS of Cham) which utilizes the known formulae of the thermodynamics and, therefore, not herebelow illustrated for clarity and simplicity purposes.

According to what illustrated in the figures, a table is given illustrating the optimum sizing of the feeder, in a parametric non-dimensional form.

TABLE 1

| | |
|---|---|
| Total height of the feeder | H |
| Height of the frustopyramid end portion | $H_2 = 0.355$ H |

TABLE 1-continued

| Total height of the feeder | H |
|---|---|
| Height of the side openings starting from below | $H_3$ = 0.127 H |
| Height of the lower openings starting from below | $H_4$ = 0.101 H |
| Height of the frustoconical joint | $H_5$ = 0.065 H |
| Height of the vertical edge of the joint | $H_6$ = 0.040 H |
| Height of the frustoconical joint inside the main duct | $H_7$ = 0.027 H |
| Equivalent diameter of the main duct | $D_1$ = 0.087 H |
| Equivalent outer diameter of the cylindrical body | $B_{=0.137\ H}$ |
| Width of the lower end of the cylindrical body | $L_{=0.300\ H}$ |
| Thickness of the free end of the cylindrical body | $B_1$ = 0.125 H |
| Equivalent diameter of the end portion of the main duct | $B_2$ = 0.064 H |
| Inner diameter of the frustoconical joint | $B_3$ = 0.118 H |
| Equivalent diameter of the side outlets | $D_2$ = 0.057 H |
| Equivalent diameter of the lower outlets | $D_3$ = 0.022 H |
| Curvature radius of the convex base | $R_1$ = 0.250 H |
| Curvature radius of edge of the lower end | $R_2$ = 0.032 H |

Then, once the optimum sizing is obtained, a prototype was created and tested on a 1:1 scale model in a mould and on which water as working fluid has been used.

The liquid steel has been chosen as referring metal fluid.

The experimental tests refer to a flow of about 10 $m_3$/h of molten metal with an average speed of the flow in the main duct of about 1.4 m/s.

Furthermore, the feeder of the molten metal of the present invention is apt to be pre-heated at a temperature comprised between $T_{liqiudus}$—600° C. and $T_{liquidus}$, being $T_{liquidus}$ the temperature at which the molten metal starts solidifying.

Additionally, the feeder according to the present invention is apt to feed a mould dipped in the bath of molten metal and at a depth equivalent to a distance comprised between 5 and 120 mm starting from the highest outlet of the feeder.

The performance of the so-constituted feeder has been compared to a two-outlet reference cylindrical feeder with horizontal axis.

Said performance refers to the level of thermal uniformity, the uniform distribution of the liquid metal, the superficial waving, the hot metal flow on the side plates and the superficial metal flow.

The comparison is given in the following table.

TABLE 2

| Performance | Reference cylindrical feeder | Feeder of the present invention |
|---|---|---|
| Thermal uniformity[a] | 100 | 61 |
| Standard deviation of the thermal gradient[b] | 100 | 85 |
| superficial waving[c] | 100 | 66 |
| Flow on the containment side walls[d] | 100 | 125 |
| Superficial flow of metal[e] | 100 | 82 |

[a]it is the ratio of the maximum difference in temperature in the orthogonal direction between the feeder of the present invention and the reference case;
[b]it is the ratio of standard deviation of the temperature gradient along the longitudinal direction between the feeder of the present invention and the reference case;

TABLE 2-continued

| Performance | Reference cylindrical feeder | Feeder of the present invention |
|---|---|---|

[c]it is the ratio between the average height of the waves occurring with the feeder of the present invention and the average height of the waves occurring in the reference case;
[d]it is the ratio of the area of the side walls wet by steel at a temperature equal or higher than solidus temperature increased by 35% by the interval of liquidus-solidus solidification with the feeder of the present invention and the total area of the containment side wall. Therefore, it is normalized compared to the reference case;
[e]it is the ratio of the average stay time of the liquid metal on the top surface around the feeder (which is the area having the lowest level of molten metal flow) between a feeder of the present invention and the reference case.

As it can be noted, the table shows the best performance obtainable with the new feeder according to the present invention compared to the reference one under the terms of thermal uniformity, superficial waving and metal flow on the top surface.

The present invention is not limited to the embodiments described above, but comprises any alternative embodiment comprised within the scope of the enclosed claims.

What is claimed is:

1. Feeder of molten metal for moulds of continuous casting machines comprising a cylindrical body (1) within which a main outflow duct (5) having an inlet area (6) for the molten metal coming from a tundish is formed to which the cylindrical body (1) is connected by means of a frustoconical joint (2), formed integrally with the cylindrical body (1) at the upper end thereof, characterized in that the lower end (3) of the cylindrical body (1) is of a frustopyramid shape with at least two sloping walls **(3*a*) diverging from each other downwards and has a plurality of downwardly directed outlet areas (7, 8, 9, 10, 11) communicating with the main outflow duct (5)** at the bottom thereof.

2. Feeder of molten metal for moulds of continuous casting machines according to claim 1, wherein each sloping wall **(3*a*)** forms an angle with the longitudinal axis of the feeder comprised between 10° and 45°.

3. Feeder of molten metal for moulds of continuous casting machines according to claim 1 wherein at least two outlets of said plurality of outlets (7, 8, 9, 10, 11) have their longitudinal axes forming an angle with the longitudinal axis of the feeder comprised between 0° and 95°.

4. Feeder of molten metal for moulds of continuous casting machines according to claim 3, wherein the angle is comprised between 65° and 95°.

5. Feeder of molten metal for moulds of continuous casting machines according to claim 1 wherein the ratio between the inlet area and the sum of the outlet areas is comprised betwen 0.4 and 1.1 and, more preferably, between 0.6 and 0.8.

6. Feeder of molten metal for moulds of continuous casting machines according to claim 1, wherein the frustopyramid-shaped lower end (3) has a flat base (4).

7. Feeder of molten metal for moulds of continuous casting machines according to claim 1 wherein the frustopyramid-shaped lower end (3) has a convex base (4).

8. Feeder of molten metal for moulds of continuous casting machines according to claim 1 wherein at least a portion of the longitudinal axes of said plurality of outlets (7, 8, 9, 10, 11) and the longitudinal axis of the feeder lie on the same plane.

9. Feeder of molten metal for moulds of continuous casting machines comprising a cylindrical body (1) within which a main outflow duct (5) having an inlet area (6) for the molten metal coming in from the tundish is formed to which the cylindrical body (1) is connected by means of a frusto-conical joint (2), formed integrally with the cylinder body (1) at the upper end thereof, and wherein the lower end (3) of the cylindrical body (1) is of a frustopyramid shape with at least two sloping walls **(3*a*) diverging from each other downwards and has a plurality of outlets (7, 8, 9, 10, 11) communicating with the main outflow duct (5), characterized in that at least two outlets (11) of said plurality of outlets (7, 8, 9, 10, 11)** have their longitudinal axes forming an angle with the longitudinal axis of said feeder comprised between 0° and 90° and each of said longitudinal axes of said at least two outlets lies on a plane orthogonal to the plane containing the longitudinal axes of the remaining outlets and of said feeder.

10. Feeder of molten metal for moulds of continuous casting machines according to claim 1 wherein the base (4) of the substantially frustopyramid-shaped lower end (3) has at least a cleft shaped outlet (12).

11. Feeder of molten metal for moulds of continuous casting machines according to claim 1, further characterized in that it is made of a refractory material chosen among the group comprising: silicon dioxide, graphite alumina and zirconium-coated graphite alumina.

12. A method of using the feeder of molten metal for moulds of continuous casting machines according to claim 1, wherein said feeder is pre-heated at a temperature comprised between $T_{liquids}$—600° C. and $T_{liquids}$, being $T_{liquids}$ the temperature at which the molten metal starts solidifying.

13. A method of using the feeder of molten metal for moulds of continuous casting machines according to claim 1, wherein said feeder to feed said mould is partially dipped in the bath of molten metal and at a depth to a distance comprised between 5 and 120 mm from the outlet area (7) which is the higher of the plurality of outlet areas (7, 8, 9, 10, 11) starting from the bottom of the feeder starting from the highest outlet of the feeder.

* * * * *